US007392607B2

(12) United States Patent
Vialle et al.

(10) Patent No.: US 7,392,607 B2
(45) Date of Patent: Jul. 1, 2008

(54) ELECTRICAL HOUSEHOLD APPLIANCE HAVING MEANS FOR DETECTING THE OPENING OF A PLUG

(75) Inventors: Marie-Alix Vialle, Estrablin (FR); Pascal Badol, Chaponnay (FR); Jean Philippe Robin, Communay (FR)

(73) Assignee: SEB S.A., Ecully (FR)

( * ) Notice: Subject to any disclaimer, the term of this patent is extended or adjusted under 35 U.S.C. 154(b) by 108 days.

(21) Appl. No.: 11/523,032

(22) Filed: Sep. 19, 2006

(65) Prior Publication Data

US 2007/0064355 A1 Mar. 22, 2007

(30) Foreign Application Priority Data

Sep. 19, 2005 (FR) ..... 05 09545

(51) Int. Cl.
*D06F 75/12* (2006.01)
*D06F 75/40* (2006.01)

(52) U.S. Cl. ..... 38/77.6; 38/77.8; 38/77.83

(58) Field of Classification Search ..... 38/77.6, 38/77.83, 77.3, 77.8, 93; 219/246, 248, 259; 392/441, 444; 340/568.1
See application file for complete search history.

(56) References Cited

U.S. PATENT DOCUMENTS

| | | | | | |
|---|---|---|---|---|---|
| 2,495,397 | A * | 1/1950 | Weber | 38/77.6 |
| 3,869,816 | A * | 3/1975 | Busby | 38/77.83 |
| 4,240,217 | A * | 12/1980 | Schwob | 38/77.83 |
| 4,854,059 | A * | 8/1989 | Ronchi | 38/93 |
| 5,052,179 | A * | 10/1991 | Fujii | 60/421 |
| 5,315,773 | A * | 5/1994 | Iwami et al. | 38/77.6 |
| 5,434,558 | A * | 7/1995 | Zeder | 340/568.3 |
| 5,621,988 | A * | 4/1997 | Bouleau et al. | 38/77.3 |
| 6,169,852 | B1 * | 1/2001 | Liao et al. | 392/395 |

FOREIGN PATENT DOCUMENTS

| | | |
|---|---|---|
| EP | 0 821 096 A | 1/1998 |
| FR | 2 835 041 A | 7/2003 |
| JP | 55 144581 A | 11/1980 |
| JP | 2005 083708 | 3/2005 |

* cited by examiner

*Primary Examiner*—Ismael Izaguirre
(74) *Attorney, Agent, or Firm*—Browdy and Neimark

(57) ABSTRACT

A household electric appliance having an orifice, or passage, closed by a plug, or stopper, wherein the appliance further includes a unit for detecting opening of the plug, the unit allowing, when power is supplied to the appliance, a detection that opening of the plug previously occurred, when power was not being supplied to the appliance.

13 Claims, 6 Drawing Sheets

ELECTRICAL HOUSEHOLD APPLIANCE HAVING MEANS FOR DETECTING THE OPENING OF A PLUG

BACKGROUND OF THE INVENTION

The present invention relates to a household electric appliance having an orifice closed by a plug, or stopper, and relates more particularly to an appliance having detection means providing assurance that opening, or removal, of the plug or the stopper has been effected by the user.

It is a common occurrence in the field of household electric appliances for the user to be required to regularly perform a maintenance operation, such as a scale removal operation, in order to assure that the appliance would have a long useful life. Thus, for ironing appliances provided with a tank for the generation of steam under pressure, it is recommended to regularly rinse the steam-generating tank with large quantities of water, for example after every ten refillings of the reservoir, in order to remove mineral deposits. Such a regular rinsing of the tank serves to prevent the deposits from accumulating in an unduly large quantity in the tank and from thus being transported by the steam flow into the iron, where the deposits would impair the operation of the iron over a period of time.

However, applicant has recognized that, in practice, the user often forgets to regularly perform this maintenance operation, to the detriment of the useful life of the appliance. In order to overcome this drawback, it is known to provide on the iron a maintenance warning light that is activated automatically, for example after a cumulative operating time of the appliance, in order to alert the user to the necessity of performing the maintenance operation. In addition, a button is provided on the appliance to turn off the warning light and reinitialize its activation cycle after the user has performed the maintenance.

However, despite the presence of this indicator, certain users still fail to perform the maintenance operation, but will depress the maintenance indicator reinitialization button without having actually performed the maintenance operation.

BRIEF SUMMARY OF THE INVENTION

The present invention serves to overcome this drawback by providing a household electric appliance comprising a plug, or stopper, that must be manipulated in order to carry out a particular operation and means for detecting opening of the plug in order to provide some assurance, as a result of this opening, that the particular operation has almost certainly been performed.

To this end, the invention provides a household electric appliance comprising an orifice, or passage, closed by a plug, or stopper, wherein the appliance further includes means for detecting opening of the plug allowing, when power is supplied to the appliance, a detection that opening of the plug previously occurred, when power was not being supplied to the appliance.

According to another characteristic of the invention, the appliance has an indicator that is activated to alert the user to the necessity of performing an operation that requires opening, or removal, of the plug, such as a maintenance operation, and a safety device preventing operation of the appliance whenever opening, or removal, of the plug has not been detected by the detection means following activation of the indicator.

According to another characteristic of the invention, the detection means include an activation finger that is displaced during removal or reinsertion of the plug and a detection circuit furnished with a switch that can be closed by a mechanical actuator that is displaced by the activation finger, the switch opening automatically when it is not urged by the mechanical actuator.

According to another characteristic of the invention, the detection means include means for locking the actuator in the switch closing position, the means for locking being unlocked by an electromagnet to which a voltage is applied by the detection circuit.

According to another characteristic of the invention, the detection means have magnetic elements.

According to another characteristic of the invention, the detection means have a circuit provided with a flexible knife switch and the plug supports a magnet that is provided to assure closing of the switch during opening, or removal, of the plug.

According to still another characteristic of the invention, the detection means include an electromagnet assuring reinitialization of the flexible knife switch to open state at the time that the appliance is placed back in operation.

According to another characteristic of the invention, the detection means include an electromagnet furnished with a movable core that cooperates with the plug in a manner such that the core is displaced from a rest position toward an active position during removal, or opening, of the plug and at least one magnet toward or away from which the core moves during its displacement.

According to another characteristic of the invention, the detection means have a circuit card that detects a change in the state of the detection circuit when power is supplied to the appliance in order to determine therefrom the opening of the plug.

According to another characteristic of the invention, the circuit card detects opening of the plug by measuring a current pulse.

According to another characteristic of the invention, the orifice is an emptying, or draining, orifice of a tank of a steam generator.

According to another characteristic of the invention, the appliance is a clothes ironing appliance.

The objects, aspects and advantages of the present invention will be better appreciated from the following description of particular embodiments of the invention presented as non-limiting examples and relating to the following attached drawings.

DETAILED DESCRIPTION OF THE INVENTION

Figure 1:
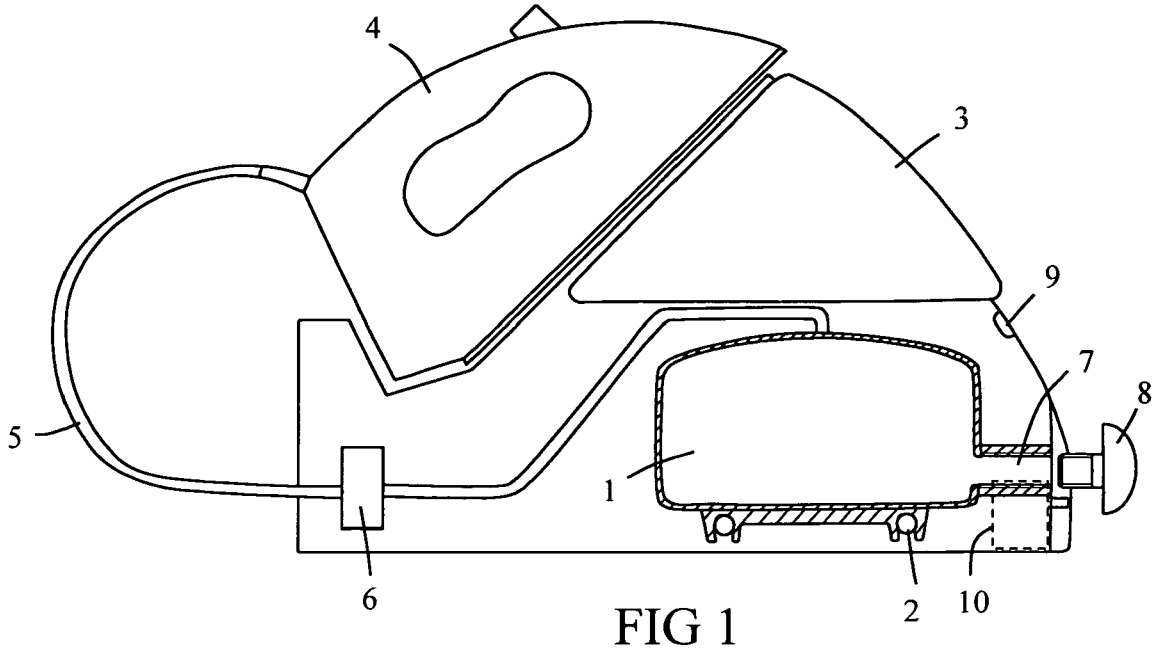
FIG. 1 is a pictorial elevational view, in partial cross section, of an iron having a separate steam generator, equipped with a device for detecting the removal of a drain plug according to the invention.

Only the elements necessary for an understanding of the invention have been illustrated. To facilitate understanding the drawings, the same elements carry the same reference numerals from one figure to another.

FIG. 1 shows a clothes ironing appliance having a steam generator comprising a steam generating tank 1 equipped with a heating element 2 and supplied with water from a reservoir 3 by a pump (not shown). Tank 1 is connected in a conventional manner to a clothes pressing iron 4 via a tube 5 provided with a solenoid valve 6 and having a drain orifice 7 that is normally closed by a threaded stopper, or plug 8, that is screwed into mating threads in orifice 7.

In order to alert the user to the necessity of emptying the tank and to avoid in particular the transfer of mineral deposits, or scale, toward the iron, the appliance is equipped with a drain indicator 9. This drain indicator can be constituted by a signal light 9, or an audible alarm, which is activated preferably after a predetermined number of operating cycles of the pump or when the cumulative operating time of the appliance has reached a given threshold.

When this drain indicator 9 is activated, the tank must be cleaned by the user. This maintenance operation can be effectuated easily by positioning the appliance at the edge of a sink, refilling the tank with water, and draining it through orifice 7 in a manner such that water loaded with mineral deposits can flow into the sink. A cleaning kit such as described in the patent FR 2 835 041 can advantageously be utilized to perform this maintenance operation.

For purposes of safety, the draining of tank 1 is normally carried out when the appliance is not connected to a power source, the electric power supply cord of the appliance being disconnected from the electric outlet.

More particularly according to the invention, the appliance is equipped with means for detecting the opening, or removal, of drain plug 8 permitting, when power is again supplied to the appliance, detection of an opening of the drain plug even if this opening of the plug took place when the appliance was not being supplied with power and/or was disconnected from the power mains.

These drain detection means are associated with a control circuit card (not shown) preventing operation of the appliance if an opening or removal of drain plug 8 was not detected at a time after drain indicator light 9 had been activated.

Figure 2:
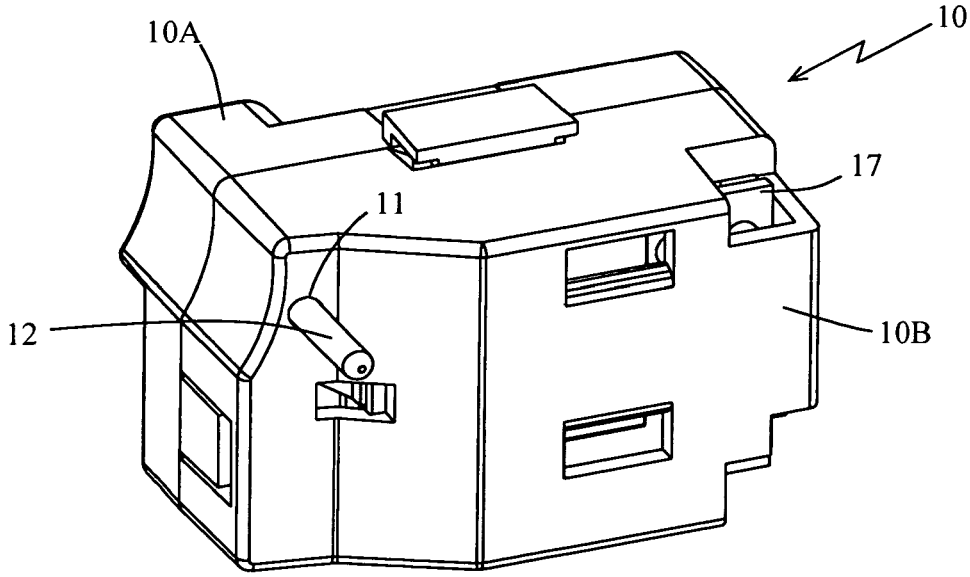
FIG. 2 is a perspective view, to a larger scale, of a device for detecting the removal of the drain plug of the generator of FIG. 1 according to the first embodiment of the invention.
Figure 3:
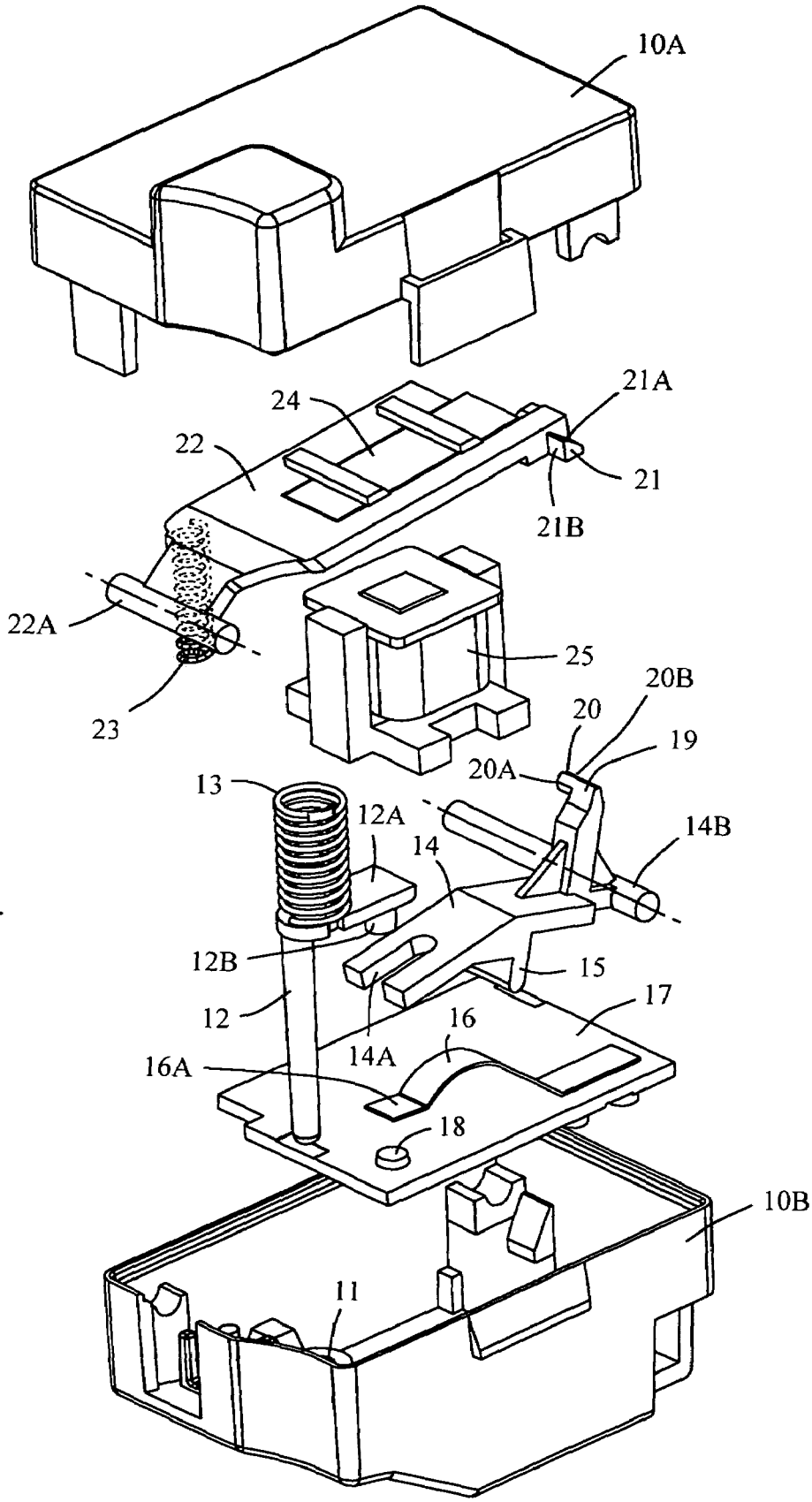
FIG. 3 is an exploded perspective view of the detection device of FIG. 2.

As can been seen more clearly in FIGS. 2 and 3, the means for detecting the opening of the drain plug are constituted by a device comprising a housing 10 provided with an orifice 11 through which an activation finger 12 slides. Activation finger 12 is maintained in a depressed state by drain plug 8 when the latter is screwed into orifice 7.

As shown in FIG. 3, housing 10 is constituted by upper and lower shells 10A, 10B, preferably made of plastic, assembled to one another. Activation finger is urged by a spring 13 into a rest position in which finger 12 projects by a substantial distance outside of housing 10. Spring 10 bears against the bottom of a cavity formed in shell 10A for this purpose.

Activation finger 12 includes a lateral extension 12A provided with a pin 12B that can come to engage into a slot 14A provided at the free end of an actuating arm 14 mounted for pivotal movement in housing 10 around the axis of a shaft 14B.

Actuating arm 14 is advantageously made of a plastic material and includes a button 15 that extends perpendicularly to the body of arm 14. Button 15 bears against a contact blade 16 that is disposed beneath the body of actuating arm 4 (with respect to orientation of FIG. 3). Contact blade 16 is carried by a printed circuit board 17. Contact blade 16 has a free end 16A located in line with a contact pin 18 carried by printed circuit board 17. The body of contact blade 16 imparts to the blade an elastic restoring force in the direction to open the switch formed by contact blade 16 and pin 18. In contrast, return spring 13 of activation finger 12 produces a force in a direction to push lateral extension 12A toward actuation arm 14 in the direction to establish contact between free end 16A of contact blade 16 and pin 18. Return spring 13 is dimensioned in such a manner that contact is established by default solely by the pressure of spring 13 when no force is being exerted by plug 8 on activation finger 12.

Actuating arm 14 has, close to its axis of rotation 14B, a locking latch 19 extending perpendicularly to the body of actuating arm 14, toward upper shell 10A. The free, or upper, end of latch 19 is provided with a head 20 that is adapted to cooperate with an abutment 21 carried by a locking arm 22 mounted for pivotal movement about the axis of a shaft 22A that is oriented to be parallel to the axis of rotation of shaft 14B of arm 14. However, shaft 22A is at the opposite end of housing 10 from shaft 14B.

Locking arm 22 is biased by a return spring 23 into a rest position in which locking arm 22 is spaced from printed circuit 17 in such a manner that abutment 21 is located along the trajectory traversed by head 20 of latch 19.

In an advantageous manner, head 20 of latch 19 presents a rounded face 20A adapted to come in contact with an inclined face 21A of abutment 20 when actuating arm 14 pivots in the direction for establishing contact between contact blade 16 and pin 18, in a manner such that, during this rotation of actuating arm 14, head 20 passes above abutment 21 while producing a slight pivoting of locking arm 22 in opposition to return spring 23. Inversely, head 20 of latch 19 presents, opposite rounded face 20A, a flat face 20B orientated substantially radially with respect to the axis of rotation of shaft 14B of actuating arm 14 and coming into contact with a flat face 21B of abutment 21 in order to oppose rotation of actuating arm 14 in a direction away from printed circuit 17, so that abutment 21 assures locking of actuating arm 14 in the position in which end 16A of contact blade 16 contacts pin 18.

Locking arm 22 is preferably made of a plastic material and supports a ferromagnetic piece 24 adapted to cooperate with an electromagnet 25 disposed under locking arm 22 and carried by printed circuit board 17. Electromagnet 25 is connected in series with the switch formed by contact blade 16 and pin 18, by means of conductive paths provided on printed circuit board 17, in a manner to form a detection circuit that is supplied with current when power is being supplied to the appliance.

The appliance also has current measuring means integrated, for example, into an circuit card, not shown in FIGS. 1-7, permitting detection of the presence of a current pulse in the resulting detection circuit.

The operation of the device for detecting the opening of plug 8 will now be described with reference to FIGS. 4-7.

Figure 4:
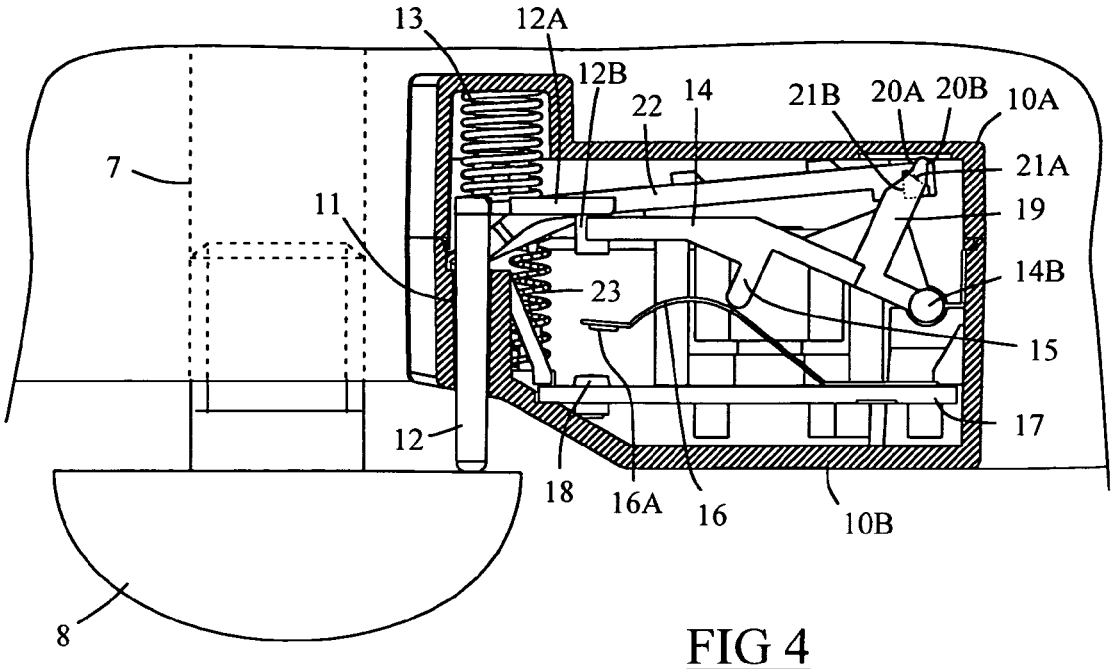
FIGS. 4-7 are detail views, in partial cross section, of the detection device of FIG. 2 in various operating states.

FIG. 4 illustrates the detection device in an initial position in which the appliance is connected to receive power and plug 8 is screwed into drain orifice 7. In this position, plug 8 maintains activation finger 12 in a depressed state against the action of spring 13, while the elastic restoring force of contact blade 16 assures opening of the connection between blade 16 and pin 18 and provokes pivoting of actuation arm 14 toward upper shell 10A until the latter comes to bear against lateral extension 12A of activation finger 12. Pin 12B then comes to be inserted into slot 14A. Rounded face 20A of head 20 is then brought to bear against inclined face 21A of abutment 21 of locking arm 22, the latter being maintained in its rest position by the action of return spring 23.

Figure 5:
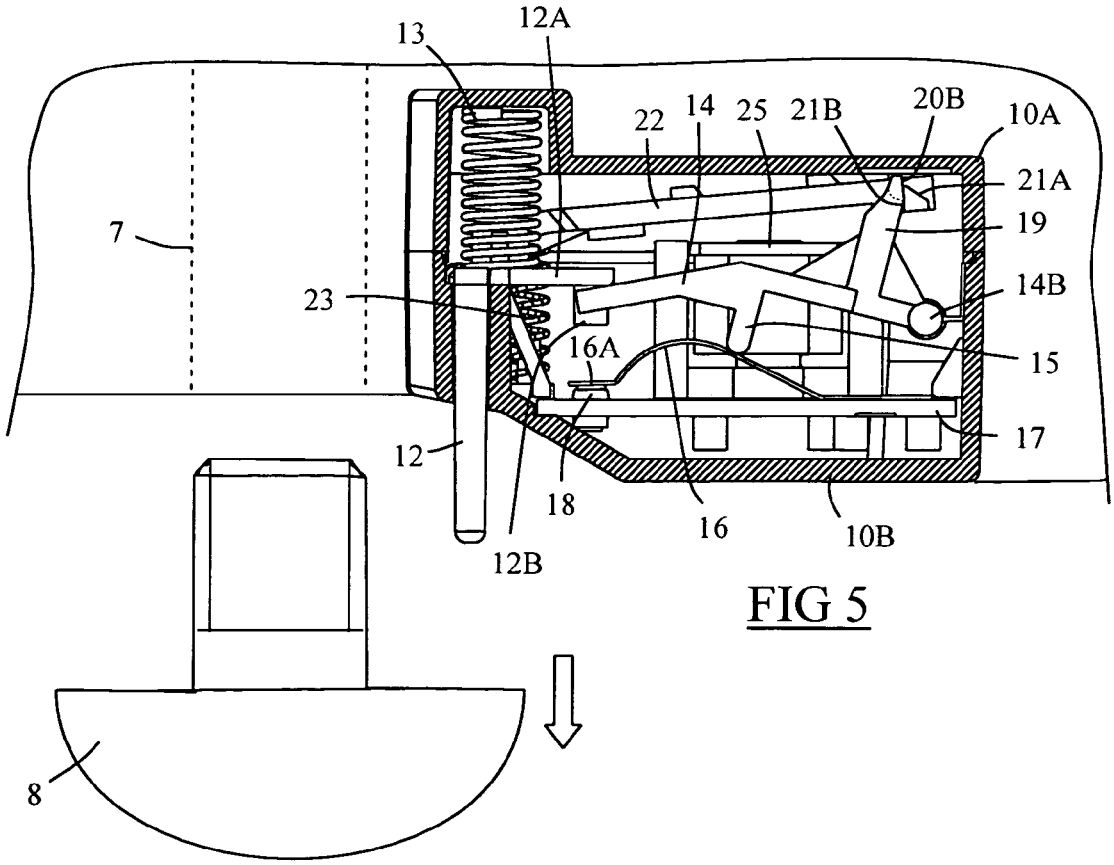

As shown in FIG. 5, when the user unscrews plug 8 in order to allow draining of tank 1, activation finger 12 is displaced toward plug 8 under the action of spring 13 and lateral extension 12A causes actuating arm 14 to rotate in the direction of printed circuit board 17 until button 15 establishes contact between blade 16 and pin 18. During this rotation of actuating arm 14 under the action of spring 13, rounded face 20A of head 20 of latch 19 bears against inclined face 21A of abutment 21, producing a slight pivoting of locking arm 22 in opposition to return spring 23. After head 20 of latch 19 passes beyond abutment 21, locking arm 22 is brought into its initial position by the action of its spring 23 and flat face 21B of abutment 21 is then located along the trajectory of movement of flat face 20B of head 20 of latch 19, thus preventing any opposite movement of actuating arm 14. Actuating arm 14 is then blocked in the position, illustrated in FIG. 5, in which blade 16 is held in contact with pin 18.

Figure 6:
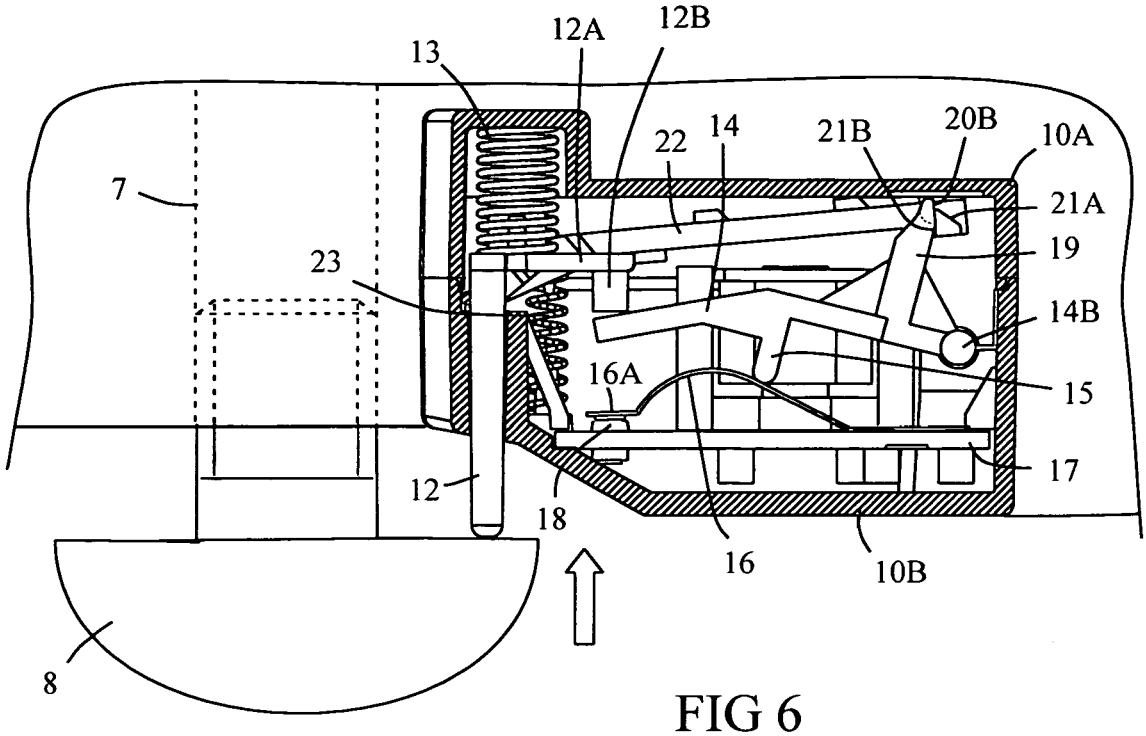

After the user has effectuated rinsing of tank 1, he closes orifice 15 by screwing plug 8 back in place, as illustrated in FIG. 6. thus depressing activation finger 12 into housing 20. Lateral extension 12A then moves away from actuating arm 14. Actuating arm 14 remains, however blocked by locking arm 22, in the position in which blade 16 remains in contact with pin 18.

When the user again wishes to use the ironing appliance, he connects it to the power mains and supplies a voltage to the appliance. A voltage is then imposed on the detection circuit and, the switch formed by contact 16 and pin 18 being closed, electromagnet 25 is supplied with current through that switch so that the electromagnet produces a magnetic field that attracts ferromagnetic element 24 carried by locking arm 22. When voltage has thus been applied, the current measuring means associated with the detection circuit detect the presence of the current pulse generated by the current supplied to electromagnet 25, which current pulse indicates that plug 8 had been opened, or removed, before voltage was again supplied to the appliance.

Figure 7:
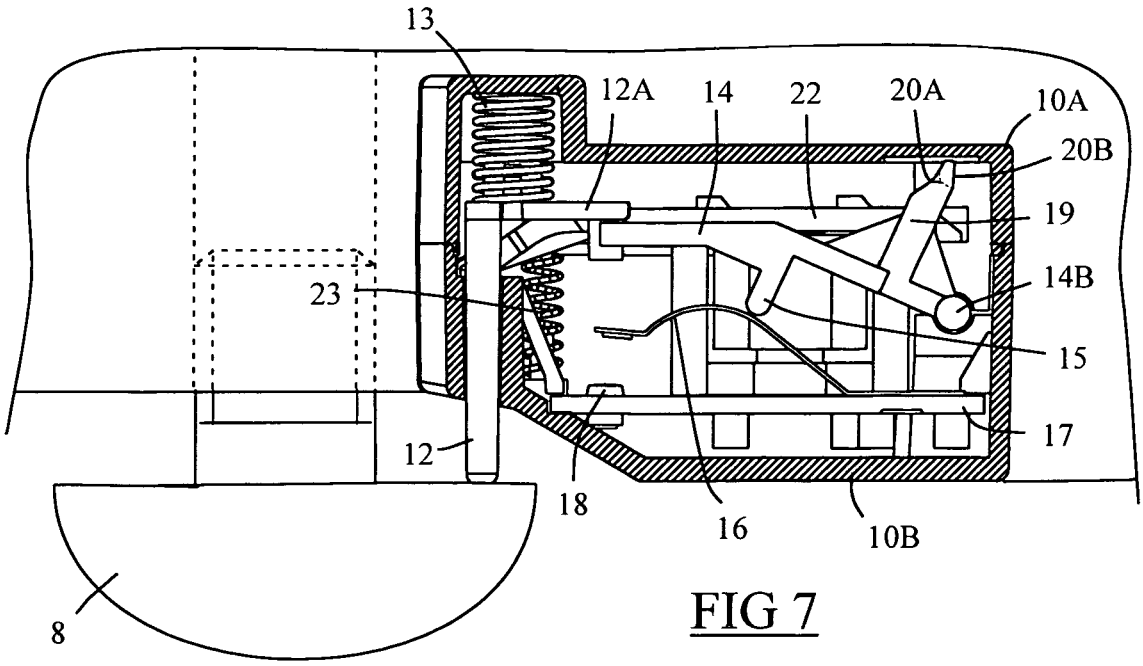

Under the action of the magnetic field created by electromagnet 25, locking arm 22 pivots in the direction of electromagnet 25 and flat face 21B of abutment 21 moves away from the trajectory of head 20 of latch 19 in such a manner that actuating arm 14 is free to pivot in the direction to break the contact between blade 16 and pin 18 due to the elastic restoring action of blade 16. This pivoting of actuating arm 14 is then effectuated until the free end of actuating arm 14 comes into contact with lateral extension 12A of actuating finger 12, as shown in FIG. 7. Opening of the connection between blade 16 and pin 18 accompanying the pivoting of actuating arm 14 provokes interruption of the supply of electric power to electromagnet 25 so that locking arm 22 returns to its rest position and the detection device is then in the initial position shown in FIG. 4.

The resulting appliance has a detection device permitting, when power is supplied to the appliance, detection of the previous opening of the plug in order to drain the tank, even though this operation had been effectuated when power was not being supplied to the appliance. Of course, the disclosed device also functions if the plug was opened while power was being supplied to the appliance.

Operation of the appliance is thus prevented starting from the instant when the maintenance indicator is activated and as long as opening of the drain plug has not been detected. The user is thus obliged to open the drain plug, and thus to effect drainage of the tank, before being able to again use the appliance. Finally, information relating to the opening of the drain plug can advantageously be used to reinitialize in an automatic manner the module for activating the drain indicator when the plug is open, or removed.

Figure 8:
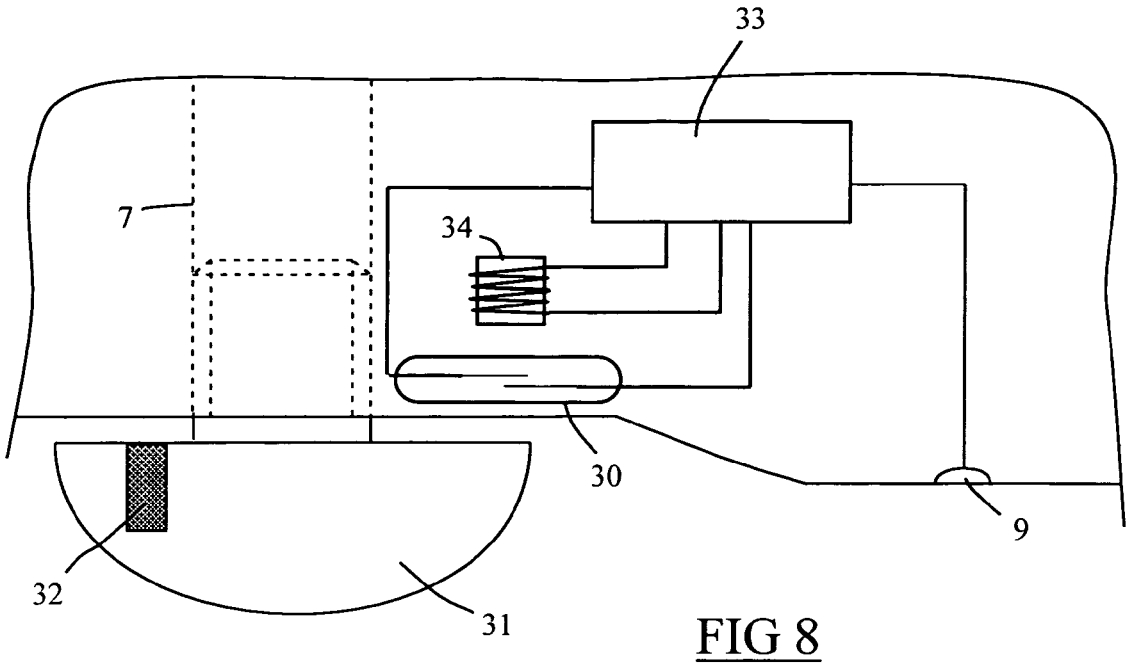
FIGS. 8 and 9 are simplified pictorial plan views of a device for detection of the removal of the drain plug according to a second embodiment of the invention.
Figure 9:
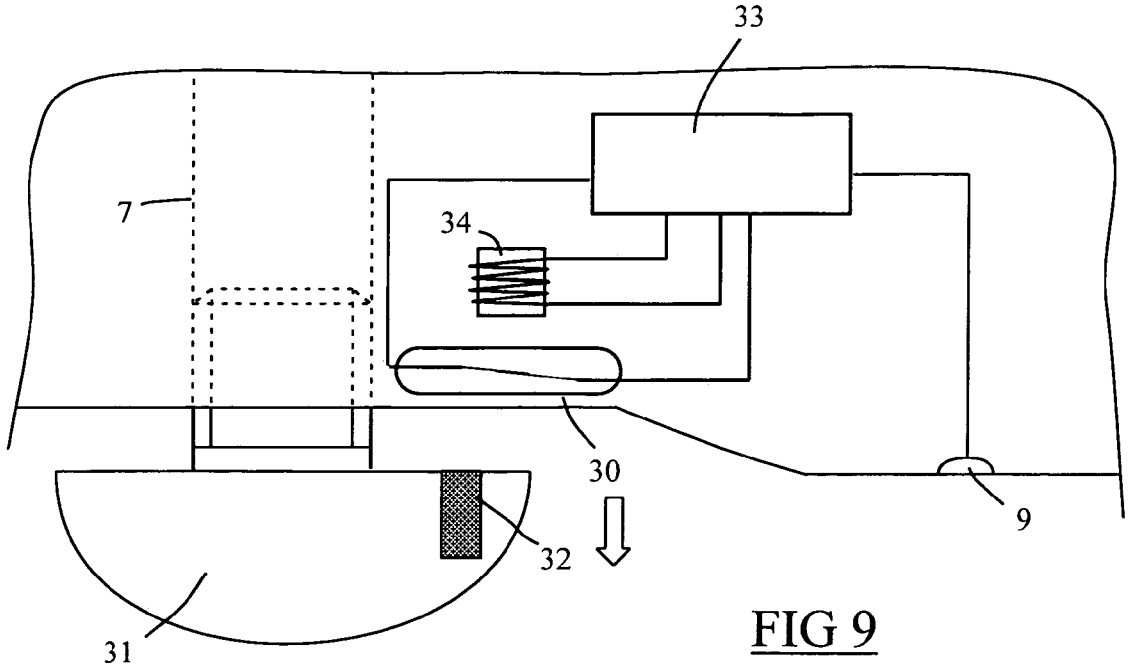

FIGS. 8 and 9 illustrate a second embodiment of the invention in which the means for detecting the opening of the drain plug of the embodiment shown in the preceding figures are replaced by a detection device having a flexible knife switch 30 mounted in the appliance in proximity to drain orifice 7 in a zone through which plug 31 passes. The device further includes a magnet 32 that is mounted in the head of plug 31 at a location that is spaced from the axis of the plug in such a manner that magnet 32 will be displaced away from switch 30 when plug 31 is screwed all the way into the threads provided in orifice 7, as shown in FIG. 8. In this position, the strength of the field produced by permanent magnet 32 in the vicinity of switch 30 is insufficient to provoke closing of the switch, which then remains in its initial open state. On the other hand, switch 30 is closed under the effect of that magnetic field when magnet 32 passes close to switch 30, as occurs when plug 31 is being unscrewed, as shown in FIG. 9.

Plug 30 is connected to an electric circuit card 33 that detects the change in the state of switch 30 when the appliance is placed in operation, in order to provide an indication that plug 31 has been unscrewed to allow draining of the tank, the circuitry on card 33 then supplying current to an electromagnet 34 to cause the electromagnet to produce a magnetic field that acts to open switch 30, i.e. to return switch 30 to its initial position as shown in FIG. 8.

Such a detection device presents the advantage of considerable simplicity, but also presents the disadvantage of increased fabrication cost due to the use of a flexible knife switch.

Figure 10:
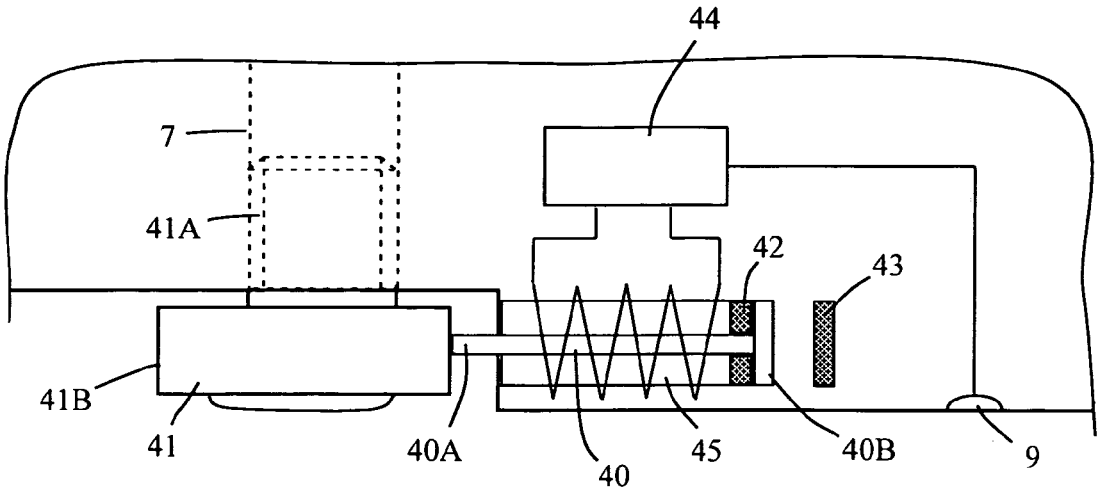
FIG. 10 is a pictorial plan view of a device for detecting the removal of the drain plug according to a third embodiment of the invention.
Figure 11:
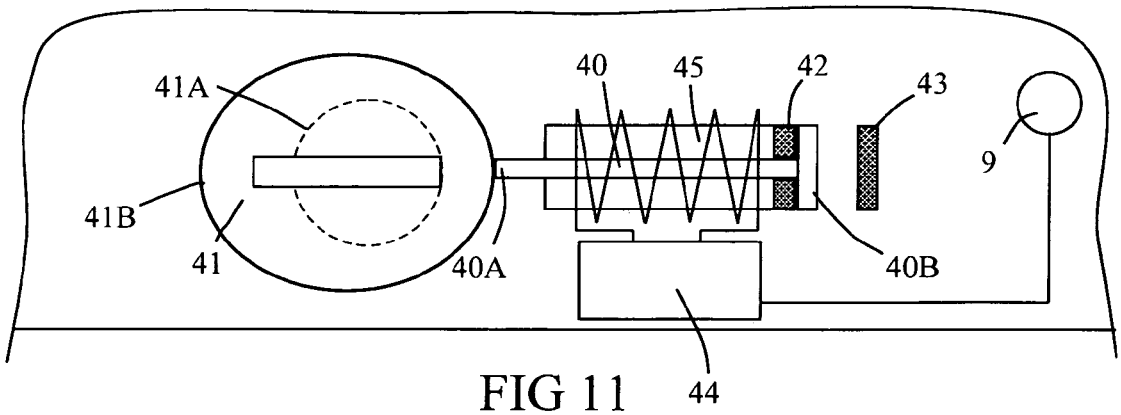
FIGS. 11 and 12 are pictorial side views of the detection device of FIG. 10 when the plug is, respectively, in a screwed in position and an unscrewed position on the drain orifice.
Figure 12:
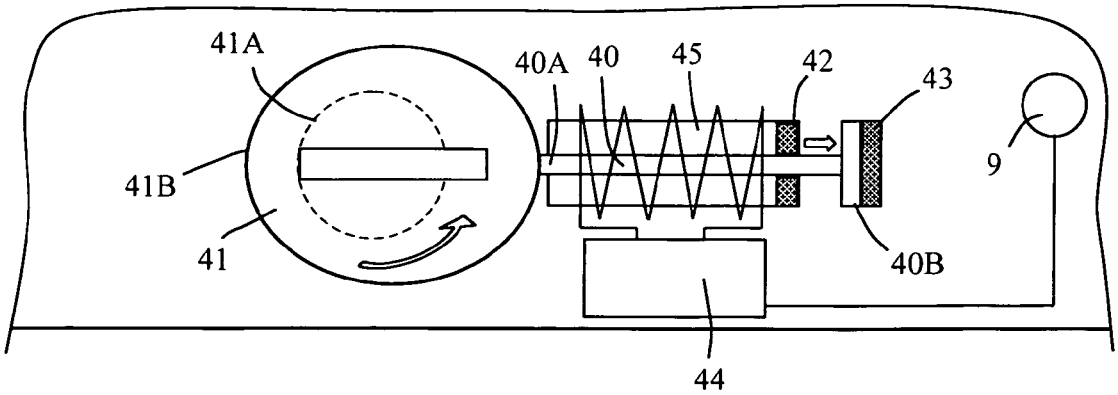

FIGS. 10-12 illustrate another embodiment of the invention in which the means of FIG. 1 for detecting opening of the drain plug are replaced by a detection device having a ferromagnetic core formed by an actuation shaft 40 that is movable in translation through the coil of an electromagnet 45. Shaft 40 has a first end 40A that is located to be in immediate proximity to the body of drain plug 41 and a second end provided with a ferromagnetic disk 40B that is located in proximity to a first magnet 42 which produces a magnetic attraction force that assures maintenance of shaft 40 in its rest position, illustrated in FIGS. 10 and 11.

As shown in these figures, plug 41 has a threaded part 41A adapted to block drain orifice 7 and also has a body 41B forming a head of the plug and having an oblong form that is eccentric with respect to the longitudinal axis of threaded part 41A, in such a manner that the periphery of body 41B of the plug forms a cam that will act to displace end 40A of shaft 40 toward electromagnet 45 during a 180° rotation of plug 41 at the time it is being unscrewed from orifice 7.

The rotation of plug 41 in an opening direction is accompanied thus by a displacement of shaft 40 toward its active position, shown in FIG. 12, in which position end disk 40B of shaft 40 comes into proximity with a second magnet 43 producing a magnetic attraction force that assures maintenance of safety shaft 40 in the active position. Both magnets 42 and 43 can be permanent magnets.

Electromagnet 45 is connected to a circuit card 44 that supplies current to electromagnet 45 when the appliance is placed into operation in order to generate a magnetic field that will act in a direction to return shaft 40 to its rest position and which monitors the electric current pulse generated by current flow through electromagnet 45 in order to determine whether shaft 40 was in its initial position at the time that the appliance was placed back into operation. Such a current pulse will have a particular form and value if the supply of current to the electromagnet produces a movement of shaft 40. The circuit card can thus determine whether or not plug 41 was previously unscrewed in order to carry out a draining operation.

The operation of an appliance according to the invention is to be blocked by the means for detecting the opening of the drain plug only after drain indicator 9 has been activated and drain indicator 9 is to be turned off, or deactivated, after the means for detecting the opening of the drain plug have produced an indication that this has occurred. For this purpose, as shown in FIGS. 8-12, drain indicator 9 is connected to circuit card 33 or 44 to be activated and deactivated by suitable control circuitry on the card. When drain indicator 9 is deactivated, indicating that no maintenance operation is need, the circuitry on the card will render the means for detecting inactive, e.g., bypass those means. After drain indicator 9 has been activated, it will subsequently be deactivated in response to opening of the plug and the re-supply of power to the appliance. This can involve resetting a counter to zero after a predetermined number of operating cycles of a water supply pump or by resetting to zero a device that measures the cumulative operating time of the appliance. This circuitry can be designed according to principles and practices already known in the control circuit design art.

This application relates to subject matter disclosed in French Application number FR 05 09545, filed on Sep. 19, 2005, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A household electric appliance comprising: a body enclosing a reservoir and having an orifice; a plug for closing said orifice; means for detecting at least partial removal of said plug from said orifice and for determining, at a time when power begins to be supplied to said appliance, that at least partial removal of said plug had previously occurred at a time when power was not being supplied to said appliance.

2. Appliance according to claim 1, wherein said means comprise: an indicator that is activated to alert a user to the necessity of performing an operation that requires removal of said plug from said orifice; and a safety device preventing operation of said appliance whenever removal of said plug has not been detected following activation of said indicator.

3. Appliance according to claim 2, wherein said means comprise: an activation finger that is displaced during removal of said plug from said orifice and reinsertion of said plug into said orifice; and a detection circuit comprising a switch and a mechanical actuator that is displaced by said activation finger for closing said switch, said switch being adapted to open automatically when said switch is not being urged by said mechanical actuator.

4. Appliance according to claim 3, wherein said means comprise: locking means for locking said actuator in the switch closing position; and an electromagnet connected to receive a voltage from said detection circuit operating said locking means to unlock said actuator.

5. Appliance according to claim 1, wherein said means have magnetic elements for producing an indication when said plug is at least partially removed from said orifice.

6. Appliance according to claim 5, wherein the means comprise a circuit provided with a flexible knife switch, and at least one of said magnetic elements is supported by said plug and is adapted to assure closing of said switch during removal of said plug from said orifice.

7. Appliance according to claim 6, wherein said means comprise an electromagnet operable to assure resetting of said flexible knife switch to an open state at a time when power begins to be supplied to said appliance.

8. Appliance according to claim 5, wherein said means comprise: an electromagnet having a movable core that is movable with said plug in a manner such that said core is displaced from a rest position toward an active position during removal of said plug from said orifice; and at least one magnet mounted so that said core is movable toward and away from said magnet.

9. Appliance according to claim 1, wherein said means comprise an electronic circuit card connected and operable for producing an indication, at a time when power begins to be supplied to said appliance, of whether said plug had been at least partially removed from said orifice prior to said time when power begins to be supplied to said appliance.

10. Appliance according to claim 9, wherein said electronic circuit card is operative to detect at least partial removal of said plug by measuring a current pulse.

11. Appliance according to claim 1, wherein said body comprises a tank of a steam generator.

12. Appliance according to claim 11, wherein said appliance comprises a clothes ironing appliance.

13. Appliance according to claim 1, wherein said means comprise: an activation finger that is displaced during removal of said plug from said orifice and reinsertion of said plug into said orifice; and a detection circuit comprising a switch and a mechanical actuator that is displaced by said activation finger for closing said switch, said switch being adapted to open automatically when said switch is not being urged by said mechanical actuator.

* * * * *